US006170915B1

(12) United States Patent
Weisz

(10) Patent No.: US 6,170,915 B1
(45) Date of Patent: Jan. 9, 2001

(54) SEAT ASSEMBLY

(75) Inventor: Peter Weisz, Richmond Hill (CA)

(73) Assignee: L&P Property Management Company, South Gate, CA (US)

( * ) Notice: Under 35 U.S.C. 154(b), the term of this patent shall be extended for 0 days.

(21) Appl. No.: 09/252,380

(22) Filed: Feb. 18, 1999

(51) Int. Cl.[7] ..... A47C 7/02

(52) U.S. Cl. ..... 297/452.5; 297/452.52; 5/259.1; 267/87

(58) Field of Search ..... 297/452.49, 452.5, 297/452.51, 452.52, 452.53; 5/259.1, 267, 270, 230, 231; 267/87, 91

(56) References Cited

U.S. PATENT DOCUMENTS

| | | | | |
|---|---|---|---|---|
| D. 348,162 | | 6/1994 | Issacs . | |
| 441,653 | | 12/1890 | Foster . | |
| 673,509 | | 5/1901 | Staples . | |
| 752,783 | * | 2/1904 | Kilmer | 5/259.1 |
| 793,172 | | 6/1905 | Bigelow . | |
| 1,036,904 | | 8/1912 | Raftery . | |
| 1,164,534 | | 12/1915 | Lewis . | |
| 2,158,647 | * | 5/1939 | Wolfe | 267/87 |
| 2,186,548 | * | 1/1940 | Lotz | 267/87 |
| 2,305,530 | * | 12/1942 | Hopkes | 267/87 |
| 2,395,402 | | 2/1946 | Fisher . | |
| 2,675,065 | * | 4/1954 | Keller | 267/87 |
| 3,715,766 | | 2/1973 | Slominski . | |
| 4,819,920 | | 4/1989 | Barber . | |
| 4,886,250 | | 12/1989 | Lucas . | |
| 5,188,343 | | 2/1993 | Galea . | |
| 5,615,869 | | 4/1997 | Phillips et al. . | |

* cited by examiner

*Primary Examiner*—Anthony D. Barfield
(74) *Attorney, Agent, or Firm*—Wood, Herron & Evans, LLP

(57) ABSTRACT

A seat assembly with a frame supporting a spring construction therein for providing resilient support to a user. The spring construction having parallel sinuous springs and plural coil springs connected together by upper stabilizer wires. Support wires are secured to the coil springs at their bottom turns by transversely laid stabilizer wires and tie wires.

8 Claims, 2 Drawing Sheets

SEAT ASSEMBLY

FIELD OF THE INVENTION

This invention relates to a seat assembly. More particularly, this invention relates to a wire construction for a sprung seat assembly.

BACKGROUND OF THE INVENTION

Prior to the use of springs, seat cushions were simply stuffed with matting, fill or other soft fibers. After a period of use, the cushion stuffing would settle, often resulting in a hard, lumpy, uncomfortable cushion.

The advent of the coil spring solved many of the prior problems. The early coil springs were placed in a frame under the seat cushion padding in a sufficient number of rows to provide proper seating support. The coil springs advantageously provided a consistent spring resilience throughout the seating area. However, this manner of providing cushion seating was expensive due to the large number of coil springs needed to support a cushion in a consistent manner.

The development of the sinuous spring caused many manufacturers to adopt this spring as an economical substitute for the prohibitively priced coil spring structure. The sinuous springs have a zig-zag pattern and are generally disposed in an upwardly bending arc between two parallel sides of a frame. Rows of sinuous wire springs are generally attached in a parallel alignment between the front and rear walls of cushion seating frames, offering both comfort and resilience. While the substitution of sinuous springs for coil springs reduced the amount of wire and the cost of the springs by between 60 and 80%, the firmness and comfort offered by only the rows of sinuous wires did not meet the needs of all. Heavier people found that the sinuous wire springs designed for people of average weight do not provide the desired resilience and have a tendency to bottom out. "Bottoming out" as used in this application, is a term of art generally referring to that condition in which the force which has been applied to the springs in a cushion exceeds the ability of the springs to resiliently resist the applied force, thus causing the springs to sag to a position in which further travel of the springs is restrained by supporting structure or by the fully extended springs. The use of stronger, stiffer springs, while providing more comfort to heavier persons, proved to be too hard and uncomfortable for lighter persons. The problem of providing proper support and resilience in cushion seating for heavier persons has also been compounded by the fact that the average person of today is bigger and heavier than the average person of 40 years ago. In addition, today's consumer is more sophisticated and demanding than in the past. Thus, the requirements for seat cushion constructions which can provide acceptable levels of support and comfort to a broader spectrum of people are more demanding today than in the past.

Attempts to overcome the aforementioned problems and to provide cushion seating with comfort and resilience have included the combination of sinuous springs and coil springs. The coil springs were often placed between a flexible base support and the sinuous springs to provide more resilience to the sinuous spring. For example, U.S. Pat. No. 2,234,253 discloses a spring cushion construction which includes a plurality of parallel-disposed sinuous springs with coil springs disposed beneath them. The lower ends of the coil springs are supported by another row of sinuous springs extending transversely to the top row. U.S. Pat. No. 2,280, 912 discloses a spring arrangement for bedsprings, boxsprings, etc., having a plurality of parallel sinuous springs form the top surface of the cushion spring assembly. The sinuous springs are secured to tapered coil springs which are in turn secured to a lower level of sinuous springs transversely positioned with respect to the top sinuous springs. U.S. Pat. No. 4,597,566 discloses another form of spring cushion seating in which coil springs are placed between a plane of nonresilient wires, supported on the frame by helical edge springs, and a base bar. However, this patent does not provide the feel traditionally associated with the use of sinuous springs.

Furthermore, traditional spring cushion seating is generally heavy due to the amount and composition of the structure used to provide support to the sinuous and coil springs. While the cushion spring structures of the prior art solved some of the problems inherent with sinuous wire-only spring structures by reducing the tendency to bottom out, the prior art structure still lacks the requisite combination of firmness and deep resilience which is desirable in cushion seating today and that, in manufacture, results in a relatively lightweight finished product.

OBJECTIVES OF THE INVENTION

It is therefore an objective of the invention to provide a seat assembly having a reduced overall weight.

It is another objective of the present invention to provide a seat assembly having deep resilient support secured to a lightweight support structure.

It is a further objective of the present invention to provide a lightweight seat assembly that allows a user to variably select the position of the sprung elements therein to provide varying degrees of resilient support.

SUMMARY OF THE INVENTION

These objectives are achieved by creating a seat assembly having a frame with front and rear rails to which a spring structure is secured. The spring structure has a plurality of parallel and upwardly bowed sinuous springs traversing the frame from the front rail to the back rail, the sinuous springs being secured to the top edges of respective front and back rails. The sinuous springs are connected by plural upper stabilizer wires laid transversely across and secured to the sinuous springs. A plurality of coil springs are also secured at their upper turns to the upper stabilizer wires.

The coil springs have lower turns secured to relatively lightweight downwardly bent support wires that are attached at either end to the top edges of the front and rear rails. Preferably, the support wires have upwardly bent portions against which the lower coil turns of the coil springs are secured. The lower turns of the coil springs are secured to each other by lower stabilizer wires running transversely to the support wires.

Relatively short tie wires are threaded over the top of the coil spring bottom turn and under the bent portion of the support wire. Either end of the tie wire is secured to the lower stabilizer wires so as to maintain the coil spring, lower stabilizer wire, and support wire in secure engagement.

The sinuous springs and coil springs provide resilient support to a user seated upon the assembly. The support wires secured to the bottom turns of the coil springs provide relatively lightweight rigid support to the sinuous and coil springs by using the transversely laid lower stabilizer wires and tie wires to maintain the coil springs secured relative to each other within the seat assembly.

The features and objectives of the present inventive seat assembly will become readily apparent from the detailed description taken in conjunction with the accompanying drawings.

DETAILED DESCRIPTION OF THE PREFERRED EMBODIMENT

Figure 1:
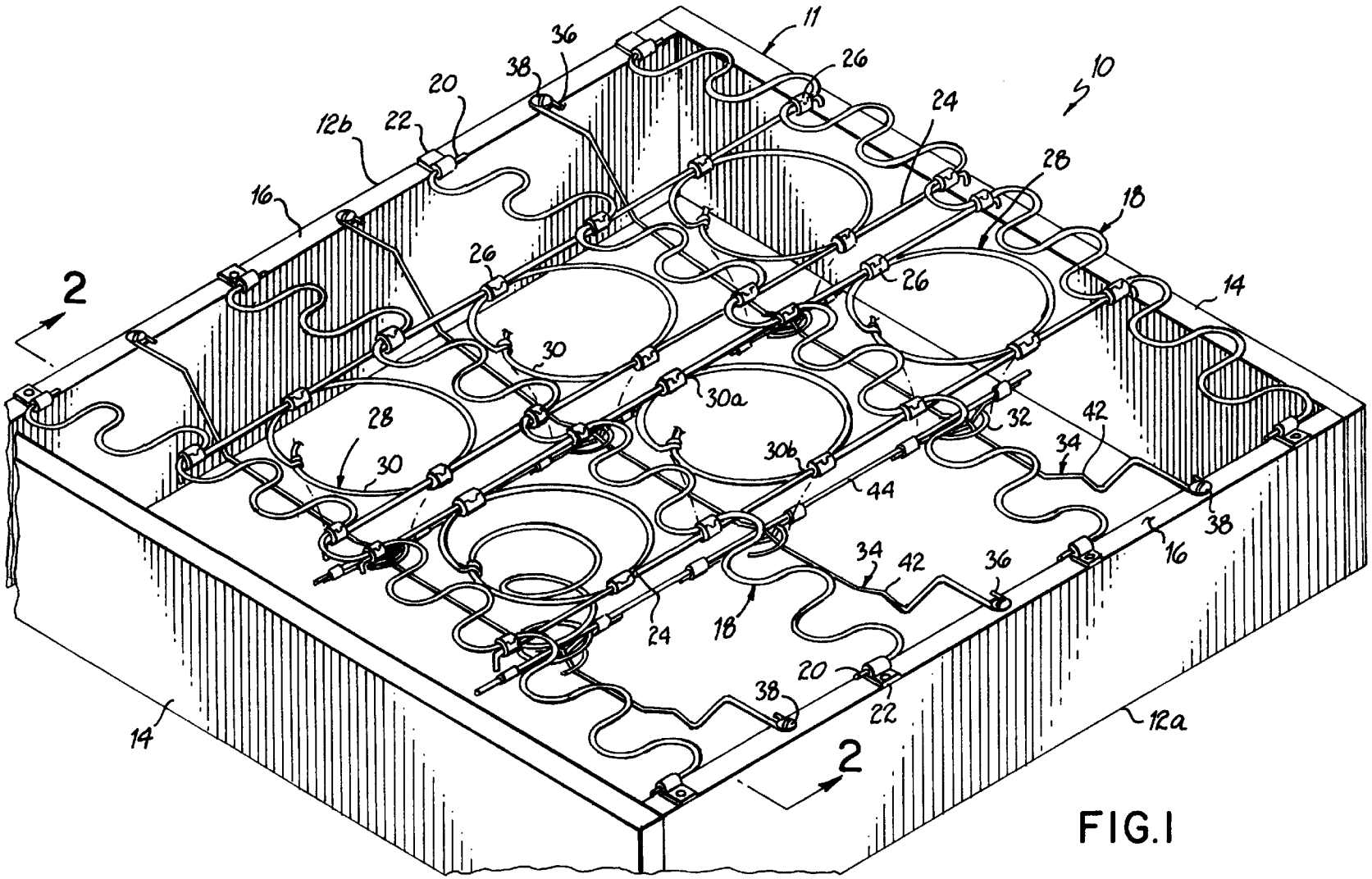
FIG. 1 is a perspective view of the spring structure of the present invention.

Referring first to FIG. 1, a seat assembly has a wooden rectangular frame 11 with a front rail 12*a*, rear rail 12*b*, and side rails 14, the side rails 14 being secured to the front and rear rails 12*a*, 12*b* by ordinary methods understood by those in the art.

Figure 2:
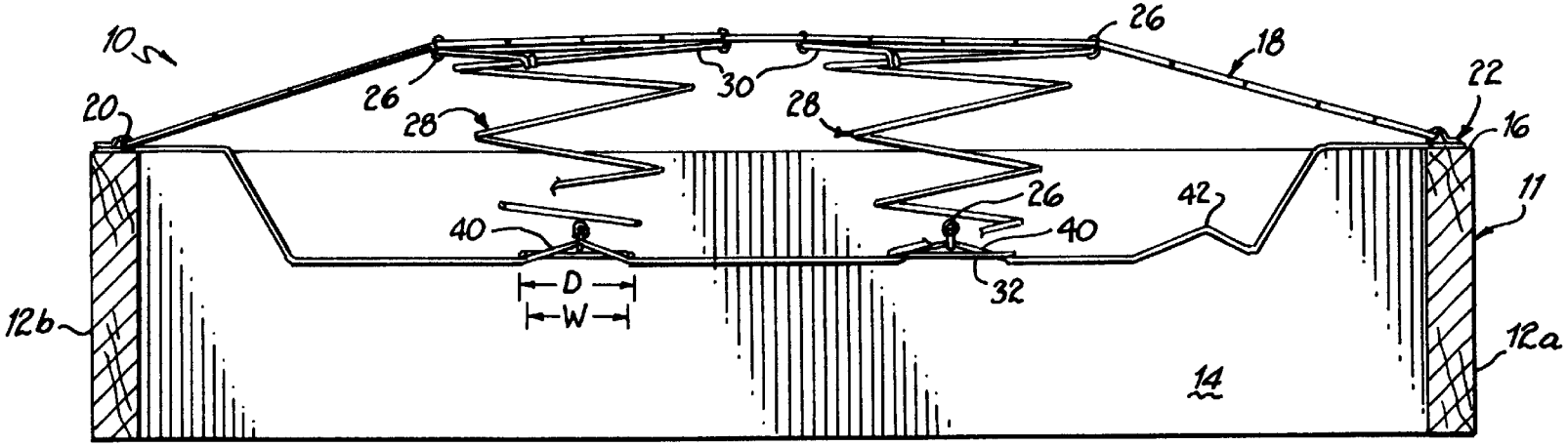
FIG. 2 is a cross-section of the seat assembly of the present invention taken along lines 2—2.

The seat assembly has a plurality of sinuous springs 18 arranged generally parallel to each other and secured at spring ends to the top edges 16 of respective front and rear rails 12*a*, 12*b* with a first fastener, e.g., a sheet metal and/or U-shaped clip 22. The sinuous springs 18 are generally upwardly bowed to provide resilient support to loads placed thereon, as seen in FIG. 2. Upper stabilizer wires 24 extend transversely to the sinuous springs 18 and are fastened to the sinuous springs 18 by second fasteners, e.g., staples 26.

A plurality of coil springs 28 are also secured to the upper stabilizer wires 24 by sheet metal clips 26. The coil springs 28 have top turns 30, secured at generally opposite points 30*a*, 30*b* to the upper stabilizer wires 24 by the sheet metal clips 26. The coil springs 28 also have bottom turns 32, generally but not necessarily smaller in diameter than the top turns 30.

Figure 3:
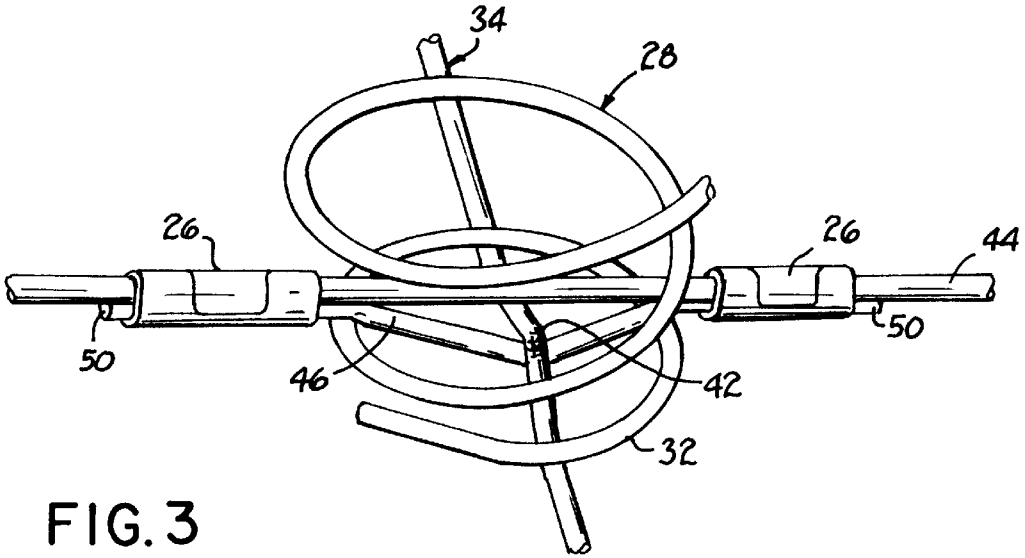
FIG. 3 is an enlarged perspective view of a lower portion of a coil spring secured to a lower support wire.

A support wire 34 has support wire ends 36 that are secured to the top edges 16 of front and rear rails 12*a*, 12*b* with third fasteners, e.g., screws 38. The support wire 34 is generally downwardly bent and runs generally parallel to the sinuous springs 18. As seen in FIGS. 2 and 3, the support wire 34 has upwardly bent sections 40 at spaced intervals which secure the bottom turns 32 of the coil springs 28 against movement relative to the support wire 34. The width W of the upwardly bent section 40 is about equal to the diameter D of the bottom turn 32. Each upwardly bent section 40 has a peak 42 that generally rises within the diameter D of the bottom turn 32. A short tie wire 46 is threaded over the bottom turn 32 and under the peak 42 of the upwardly bent section 40 of the support wire 34, effectively securing the coil springs 28 to the support wire 34. Each tie wire end 50 is secured to a lower stabilizer wire 44 that extends transversely to the support wires 34. The lower stabilizer wires 44 are aligned generally longitudinally above the tie wires 46 and generally traverse the peaks 42 of the support wire 34 and are secured to the tie wire ends by sheet metal clips 26.

In the preferred embodiment, the support wire 34 has a plurality of bent sections 40 so as to allow a user to selectively place a coil spring 28 at varying locations on the support wire, thereby, allowing a user to modify the degree of resilient support provided by the seat assembly 10.

From the above disclosure of the general description of the present invention and the summary of the preferred embodiment, those skilled in the art will comprehend the various modifications to which the present invention is susceptible. Therefore, I desire to be limited only by the scope of the following claims and equivalents thereof.

I claim:

1. A seat assembly, comprised of:

a frame for supporting the assembly, said frame comprised of a front rail, a rear rail and two opposing side rails, each of said front and rear rails having a top edge;

a plurality of generally parallel sinuous wire springs traversing said frame between said front and rear rails, said sinuous springs having first and second spring ends fastened to said top edges of said front and rear rails, respectively;

a plurality of upper stabilizer wires extending transversely to and fastened to said sinuous springs;

a plurality of coil springs each having a top turn and a bottom turn, said top turn of said coil springs being fastened to said upper stabilizer wires; and a plurality of lower support wires traversing said frame between said front and rear rails, said lower support wires having first and second support wire ends fastened to said top edges of said front and rear rails, respectively, and said bottom turns, said coil springs being supported from and secured against movement relative to said lower support wires.

2. The seat assembly of claim 1, wherein said lower support wires have a plurality of bent sections that receive said bottom turns of said coil springs.

3. The seat assembly of claim 2, wherein said bent sections of said support wires are bent generally upwardly relative to said top turn of said coil spring.

4. The seat assembly of claim 2, wherein said bottom turns of said coil springs are seated on said bent sections so that said bent sections are received generally within said bottom turns.

5. The seat assembly of claim 2, further comprised of:

a plurality of lower stabilizer wires extending transversely to said support wires; and a plurality of tie wires securing said lower stabilizer wires to said bottom turns and said support wires, said tie wires being received on an opposite side of said support wires from said stabilizer wires.

6. The seat assembly of claim 5, wherein said lower stabilizer wires extend transversely to said support wires so that said stabilizer wires are proximate to an upwardly bent section of said support wires.

7. The seat assembly of claim 5, wherein said tie wire is received on the same side of said bottom turn as said lower stabilizer wire.

8. A seat assembly, comprised of:

a frame for supporting the assembly, said frame comprised of a front rail, a rear rail, and two opposing side rails, each of said front and rear rails having a top edge;

a plurality of generally parallel sinuous wire springs traversing said frame between said front and rear rails, said sinuous springs having first and second spring ends fastened to said top edges of said front and rear rails, respectively;

a plurality of upper stabilizer wires extending transversely to and fastened to said sinuous springs;

a plurality of coil springs each having a top turn and a bottom turn, said top turn of said coil springs being fastened to said upper stabilizer wires;

a plurality of support wires traversing said frame between said front and rear rails, said support wires each having first and second support wire ends fastened to said top edges of said front and rear rails respectively, wherein each of said support wires have a plurality of upwardly bent sections receiving said bottom turns of said coil springs;

a plurality of lower stabilizer wires extending transversely to said support wires, and proximate to said upwardly bent sections of said support wires; and a plurality of tie wires secured to said lower stabilizer wires, said tie wires being located on the same side of said bottom turns of said coil springs as said lower stabilizer wires, and on an opposite side of said support wires from said stabilizer wires so as to lock said bottom turns of said coil springs therebetween.

* * * * *